US005531029A

United States Patent [19]

Hawes

[11] Patent Number: 5,531,029

[45] Date of Patent: Jul. 2, 1996

[54] DO IT YOURSELF HEM LINE MARKER WITH CHALK

[76] Inventor: Alcye Y. Hawes, P.O. Box 715 Peachtree St., Lincolnton, Ga. 30817

[21] Appl. No.: 276,832

[22] Filed: Jul. 18, 1994

[51] Int. Cl.[6] ..... A41H 23/00

[52] U.S. Cl. ..... 33/9 A; 33/2 H

[58] Field of Search ..... 33/2 H, 8, 912, 33/9 A, 10

[56] References Cited

U.S. PATENT DOCUMENTS

| | | | |
|---|---|---|---|
| 1,538,305 | 5/1925 | Smith | 33/9 A |
| 1,581,350 | 4/1926 | Kimbler | 33/9 A |
| 1,626,440 | 4/1927 | Wasserman | 33/9 A |
| 1,776,489 | 9/1930 | Cobb | 33/9 A |
| 1,853,280 | 4/1932 | MacKenzie | 33/9 A |
| 2,202,659 | 5/1940 | Ingwer | 33/9 A |
| 2,202,660 | 5/1940 | Ingwer | 33/9 A |
| 2,272,612 | 2/1942 | Levin | 33/9 A |
| 2,319,722 | 5/1943 | Collins | 33/9 A |
| 2,532,298 | 12/1950 | Goldstein | 33/9 A |

FOREIGN PATENT DOCUMENTS

| | | | |
|---|---|---|---|
| 514781 | 10/1952 | Belgium | 33/9 A |
| 537952 | 6/1922 | France | 33/9 A |
| 127536 | 3/1932 | Germany | 33/9 A |
| 3906023 | 8/1990 | Germany | 33/8 |

*Primary Examiner*—Thomas B. Will

[57] ABSTRACT

A new and improved do it yourself hem line marker with chalk comprised of a base having a rounded top surface, and a hollow interior. A recess is formed in the rounded top surface. A sand mixture is positioned within the hollow interior. The sand mixture functioning to weigh the base down. The device contains a three foot long ruler having a first end, a second end, and an intermediate extent therebetween. The first end is coupled with the recess formed in the rounded top surface of the base. The device contains a metal extension having a first open end and a second open end. The first open end is secured to the intermediate extent of the three foot long ruler. The second open end is tapered. Chalk is secured within the tapered second open end of the metal extension. The chalk functions to mark a garment.

1 Claim, 4 Drawing Sheets

DO IT YOURSELF HEM LINE MARKER WITH CHALK

BACKGROUND OF THE INVENTION

1. Field of the Invention

The present invention relates to a do it yourself hem line marker with chalk and more particularly pertains to providing a way for the user to mark hems evenly on a garment with chalk without the help of another person with a do it yourself hem line marker with chalk.

2. Description of the Prior Art

The use of hemlines gauges is known in the prior art. More specifically, hemlines gauges heretofore devised and utilized for the purpose of marking hemlines with needles are known to consist basically of familiar, expected and obvious structural configurations, notwithstanding the myriad of designs encompassed by the crowded prior art which have been developed for the fulfillment of countless objectives and requirements.

By way of example, U.S. Pat. No. 4,050,159 to Kakinuma discloses a hem-line marker.

U.S. Pat. No. 4,027,394 to Morantz et al. discloses a drapery length marking device.

U.S. Pat. No. 4,068,783 to Maier discloses a skirt maker and shaping device.

U.S. Pat. No. 4,534,501 to Berns discloses a device for marking the height above the floor of the edges of articles of clothing.

U.S. Pat. No. 3,662,931 to Arthur et al. discloses a hemline gauge.

While these devices fulfill their respective, particular objective and requirements, the aforementioned patents do not describe a do it yourself hem line marker with chalk that providing a way for the user to mark hems evenly on a garment with chalk without the help of another person.

In this respect, the do it yourself hem line marker with chalk according to the present invention substantially departs from the conventional concepts and designs of the prior art, and in doing so provides an apparatus primarily developed for the purpose of providing a way for the user to mark hems evenly on a garment with chalk without the help of another person.

Therefore, it can be appreciated that there exists a continuing need for new and improved do it yourself hem line marker with chalk which can be used for providing a way for the user to mark hems evenly on a garment with chalk without the help of another person. In this regard, the present invention substantially fulfills this need.

SUMMARY OF THE INVENTION

In the view of the foregoing disadvantages inherent in the known types of hemlines gauges now present in the prior art, the present invention provides an improved do it yourself hem line marker with chalk. As such, the general purpose of the present invention, which will be described subsequently in greater detail, is to provide a new and improved do it yourself hem line marker with chalk and method which has all the advantages of the prior art and none of the disadvantages.

To attain this, the present invention essentially comprises a do it yourself hem line marker with chalk providing a way for the user to mark hems evenly on a garment without the help of another person. The device contains a base having a flat bottom surface, a rounded top surface, and a hollow interior. A recess is formed in the rounded top surface. A sand mixture is positioned within the hollow interior. The sand mixture functions to weigh the base down. The device contains a three foot long ruler having a first end, a second end, and an intermediate extent therebetween. The first end is coupled with the recess formed in the rounded top surface of the base. The device contains a container holder having an open top receiving surface and a flat bottom surface. The container holder is adjustably coupled with the intermediate extent of the three foot long ruler by a fastening means. The device also consists of a plastic container having a top surface, a bottom surface, a hollow inner surface, and an outer surface. The plastic container is received in the open top receiving surface of the container holder. A hollow extension is integral with the top surface. An extension lid is removably secured to the hollow extension. An aperture is formed in the extension lid. A chalk powder is positioned within the hollow inner surface. The device also contains a long piece of tubing having a first end and a second end. The first end is received through the aperture formed in the extension lid of the plastic container. The long piece of tubing has a length of about four feet. The device contains a short piece of tubing having a first end and a second end. The first end is received through the aperture formed in the extension lid of the plastic container and into the chalk powder positioned therein. The second end is secured to the intermediate extent of the three foot long ruler by a fastening means. The device contains a metal extension having a first open end and a second open end. The first open end is secured to the second end of the short piece of tubing. The second open end is tapered. The last element of the device is a rubber squeeze ball having an open extension. The open extension is coupled with the second end of the long piece of tubing. The rubber squeeze ball functions to cause the chalk powder to exit the plastic container through the short piece of tubing.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved do it yourself hem line marker with chalk which has all the advantages of the prior art hemlines gauges and none of the disadvantages.

It is another object of the present invention to provide a new and improved do it, yourself hem line marker with chalk which may be easily and efficiently manufactured and marketed.

It is a further object of the present invention to provide a new and improved do it yourself hem line marker with chalk which is of durable and reliable construction.

An even further object of the present invention is to provide a new and improved do it yourself hem line marker with chalk which is susceptible of a low cost of manufacture with regard to both materials and labor, and which accordingly is then susceptible of low prices of sale to the consuming public, thereby making such a do it yourself hem line marker with chalk economically available to the buying public.

Still yet another object of the present invention is to provide a new and improved do it yourself hem line marker with chalk which provides in the apparatuses and methods of the prior art some of the advantages thereof, while simultaneously overcoming some of the disadvantages normally associated therewith.

Even still another object of the present invention is to provide a new and improved do it yourself hem line marker with chalk for providing a way for the user to mark hems evenly on a garment with chalk without the help of another person.

Lastly, it is an object of the present invention to provide a new and improved do it yourself hem line marker with chalk comprised of a base having a rounded top surface, and a hollow interior. A recess is formed in the rounded top surface. A sand mixture is positioned within the hollow interior. The sand mixture functioning to weigh the base down. The device contains a three foot long ruler having a first end, a second end, and an intermediate extent therebetween. The first end is coupled with the recess formed in the rounded top surface of the base. The device contains a metal extension having a first open end and a second open end. The first open end is secured to the intermediate extent of the three foot long ruler. The second open end is tapered. A marking means comprised of chalk is secured within the tapered second open end of the metal extension. The marking means functioning to mark a garment.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 2:
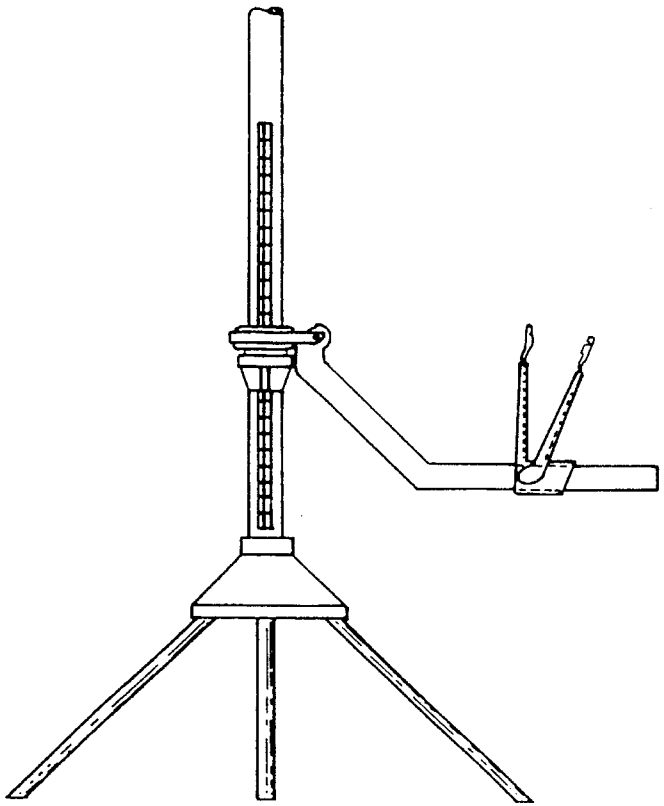
FIG. 2 PRIOR ART
FIG. 2 is a perspective view of the prior art hemline gauge.
Figure 1:
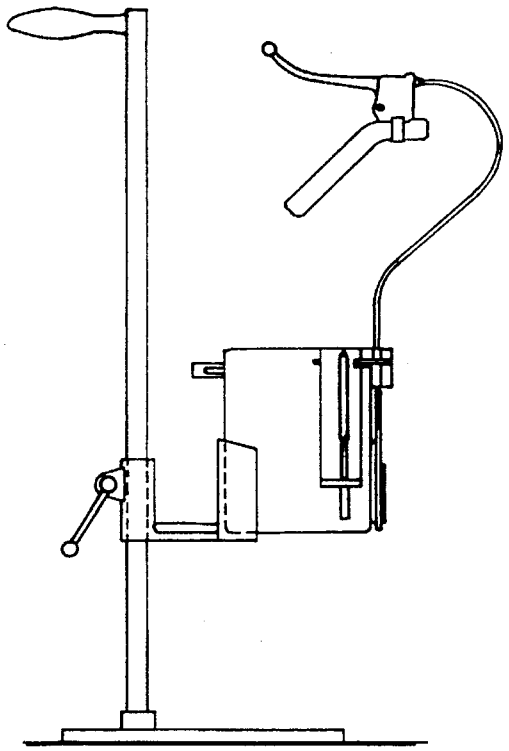
FIG. 1 PRIOR ART
FIG. 1 is a perspective view of the prior art device for marking the height above the floor of the edges of articles of clothing.
Figure 4:
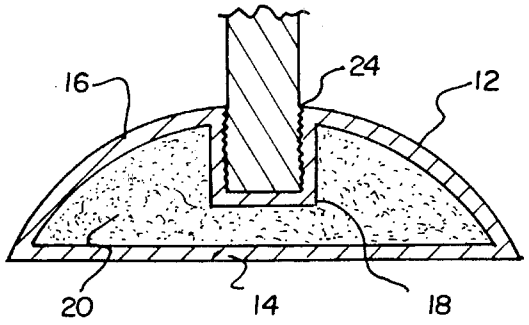
FIG. 4 is a cross-sectional view taken along line 4—4 of FIG. 3.
Figure 3:
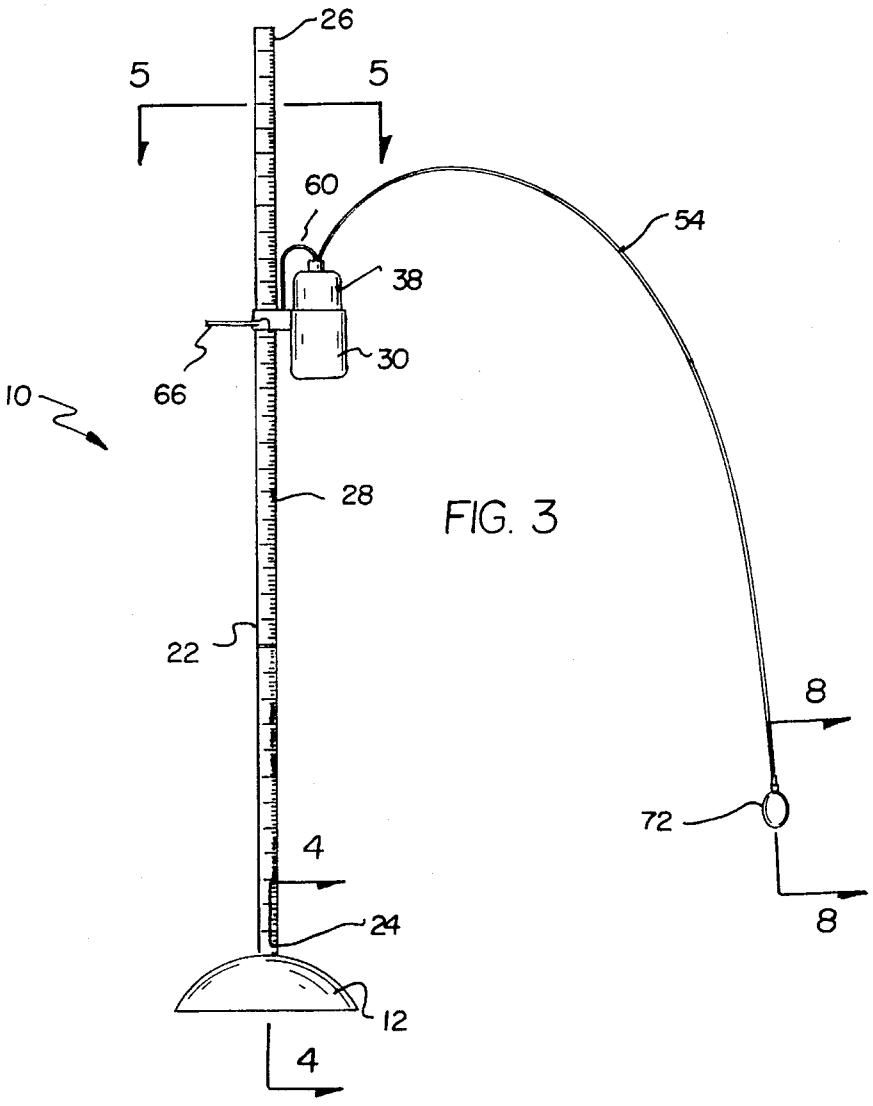
FIG. 3 is a perspective view of the preferred embodiment of the do it yourself hem line marker with chalk constructed in accordance with the principles of the present invention.
Figure 5:
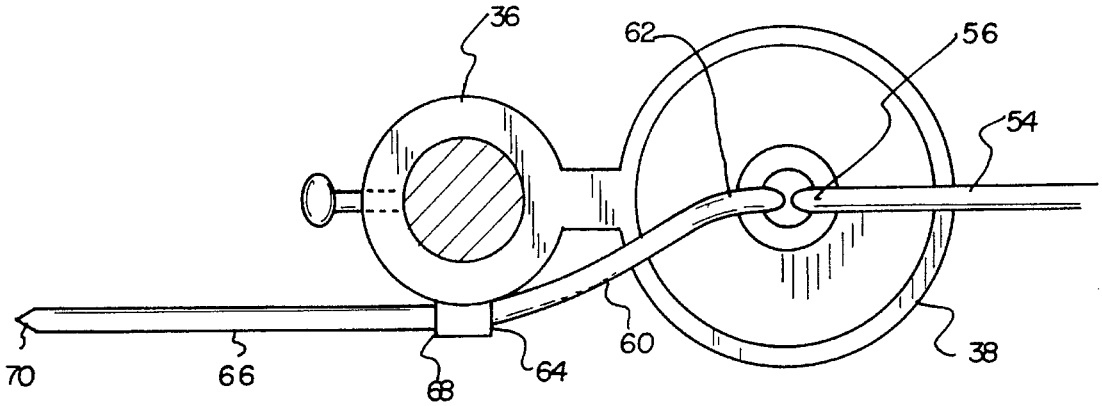
FIG. 5 is a cross-sectional view taken along line 5—5 of FIG. 3.
Figure 6:
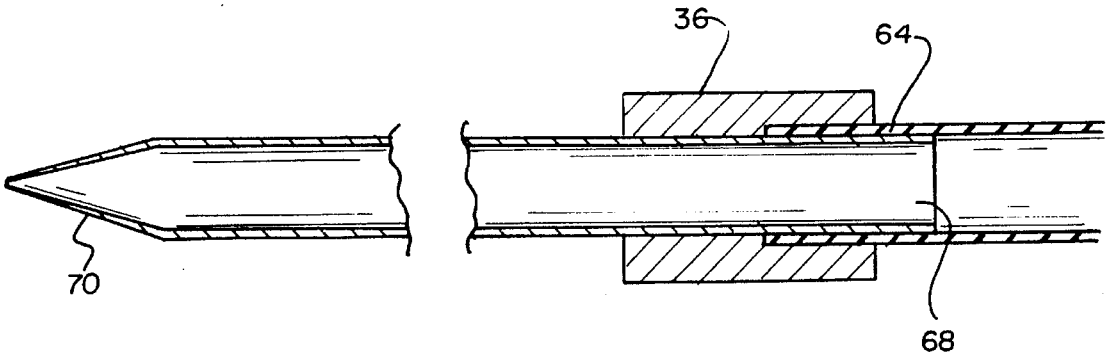
FIG. 6 is an enlarged view of the metal extension, the fastening means, and the short piece of rubber tubing.
Figure 8:
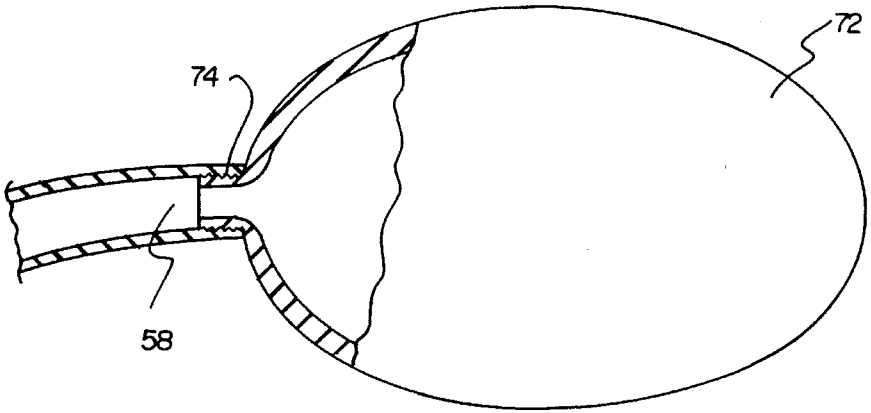
FIG. 8 is a cross-sectional view taken along line 8—8 of FIG. 3.
Figure 7:
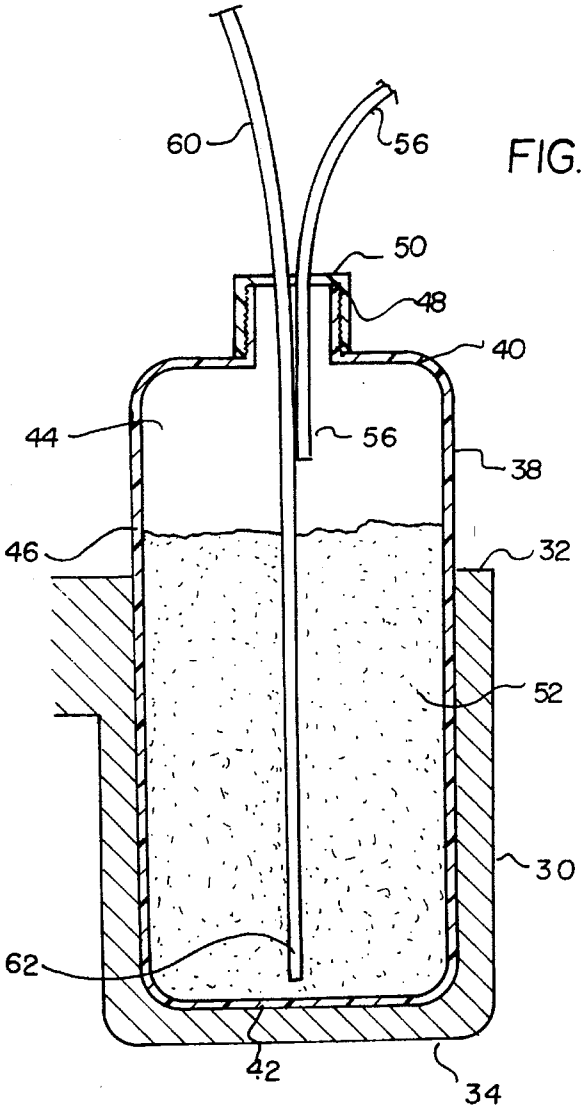
FIG. 7 is cross-sectional view of the chalk container and the holder of the container.

With reference now to the drawings, and in particular, to FIG. 3 thereof, the preferred embodiment of the new and improved do it yourself hem line marker with chalk embodying the principles and concepts of the present invention and generally designated by the reference number 10 will be described.

Specifically, it will be noted in the various Figures that the device 10 relates to a do it yourself hem line marker with chalk providing a way for the user to mark hems evenly on a garment without the help of another person. In its broadest context, the device consists of a base, a three foot long ruler, a container holder, a plastic container, a long piece of tubing, a short piece of tubing, a metal extension, and a rubber squeeze ball.

The device 10 contains a base 12 having a flat bottom surface 14, a rounded top surface 16, and a hollow interior. A recess 18 is formed in the rounded top surface. A sand mixture 20 is positioned within the hollow interior. The sand mixture 20 functions to weigh the base down.

The device 10 contains a three foot long ruler 22 having a first end 24, a second end 26, and an intermediate extent 28 therebetween. The first end 24 is coupled with the recess 18 formed in the rounded top surface 16 of the base 12. The three foot long ruler 22 can be marked in either inches or centimeters or both depending on the user and the market.

The device 10 contains a container holder 30 having an open top receiving surface 32 and a flat bottom surface 34. The container holder 30 is adjustably coupled with the intermediate extent 28 of the three foot long ruler 22 by a fastening means 36.

The device 10 also consists of a plastic container 38 having a top surface 40, a bottom surface 42, a hollow inner surface 44, and an outer surface 46. The plastic container 38 is received in the open top receiving surface 32 of the container holder 30. A hollow extension 48 is integral with the top surface 40. An extension lid 50 is removably secured to the hollow extension 48. An aperture is formed in the extension lid 50. A chalk powder 52 is positioned within the hollow inner surface 44.

The device 10 also contains a long piece of tubing 54 having a first end 56 and a second end 58. The first end 56 is received through the aperture formed in the extension lid 50 of the plastic container 38. The long piece of tubing 54 has a length of about four feet. The long piece of tubing 54 can be made of rubber or a durable plastic material.

The device 10 contains a short piece of tubing 60 having a first end 62 and a second end 64. The first end 62 is received through the aperture formed in the extension lid 50 of the plastic container 38 and into the chalk powder 52 positioned therein. The second end 64 is secured to the intermediate extent 28 of the three foot long ruler 22 by a fastening means 36. As with the long piece of tubing 54, the short piece of tubing 60 can also be made of rubber or a durable plastic material.

The device 10 contains a metal extension 66 having a first open end 68 and a second open end 70. The first open end 68 is secured to the second end 64 of the short piece of tubing 60. The second open end 70 is tapered. The tapered second end 70 forms a writing implement to discharge chalk powder onto a garment as the user is wearing the garment to mark a hem line.

The last element of the device 10 is a rubber squeeze ball 72 having an open extension 74. The open extension 74 is coupled with the second end 58 of the long piece of tubing 54. The rubber squeeze ball 72 functions to cause the chalk powder 52 to exit the plastic container 38 through the short piece of tubing 60.

One of the most tedious and error prone tasks in making a garment is getting the hem level. This usually requires two people, one to wear the garment and another to mark the hem of the garment. The marking involves measuring the desired length of the garment from the floor up with a yardstick and marking the line where it should be turned up with either pins or tailor's chalk. The present invention is a new sewing accessory to make leveling and marking hems a simple task.

The present invention is easy to use. Determine the desired length of the dress from the floor, and set the chalk container holder to that height. Position the unit so that the end of the short tube points toward the garment. Grasp the squeeze ball in one hand, and squeeze the ball while turning slowly in a circle. This will cause chalk to exit from the shorter tube out onto the garment, so that the hem is marked and leveled at the desired length. With the present invention, anyone who sews can mark level hems easily and without assistance.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A new and improved do it yourself hem line marker with chalk providing a way for a user to mark hems evenly on a garment without the help of another person comprising, in combination:

a base having a flat bottom surface, a rounded top surface, and a hollow interior, a recess formed in the rounded top surface, the recess being internally threaded, a sand mixture positioned within the hollow interior, the sand mixture functioning to weigh the base down;

a three foot long ruler having an externally threaded first end, a second end, and an intermediate extent therebetween, the externally threaded first end removably coupled with the internally threaded recess formed in the rounded top surface of the base;

a container holder having an open top receiving surface and a flat bottom surface, the container holder adjustably coupled with the intermediate extent of the three foot long ruler by a fastening means for removable securement thereto;

a plastic container having a top surface, a bottom surface, a hollow inner surface, and an outer surface, the plastic container received in the open top receiving surface of the container holder, a hollow extension integral with the top surface, an extension lid removably secured to the hollow extension, an aperture formed in the extension lid, a chalk powder positioned within the hollow inner surface;

a long piece of tubing having a first end and a second end, the first end received through the aperture formed in the extension lid of the plastic container, the long piece of tubing having a length of about four feet;

a short piece of tubing having a first end and a second end, the first end received through the aperture formed in the extension lid of the plastic container and into the chalk powder positioned therein; the second end secured to the intermediate extent of the three foot long ruler by the fastening means;

a metal extension having a first open end and a second open end, the first open end secured to the second end of the short piece of tubing, the second open end being tapered;

a rubber squeeze ball having an open extension, the open extension coupled with the second end of the long piece of tubing, the rubber squeeze ball functioning to cause the chalk powder to exit the plastic container through the short piece of tubing.

* * * * *